US008663459B2

(12) United States Patent
Al-Shahrani et al.

(10) Patent No.: US 8,663,459 B2
(45) Date of Patent: Mar. 4, 2014

(54) CATALYTIC PROCESS FOR DEEP OXIDATIVE DESULFURIZATION OF LIQUID TRANSPORTATION FUELS

(75) Inventors: Farhan M. Al-Shahrani, Dhahran (SA); Tiancun Xiao, Oxford (GB); Gary Dean Martinie, Graham, NC (US); Malcolm L. H. Green, Oxford (GB)

(73) Assignees: Saudi Arabian Oil Company, Dhahran (SA); The Chancellor, Masters and Scholars of the University of Oxford, Oxford (GB)

( * ) Notice: Subject to any disclaimer, the term of this patent is extended or adjusted under 35 U.S.C. 154(b) by 808 days.

(21) Appl. No.: 12/224,821

(22) PCT Filed: Mar. 5, 2007

(86) PCT No.: PCT/US2007/005838

§ 371 (c)(1),
(2), (4) Date: Dec. 17, 2008

(87) PCT Pub. No.: WO2007/103440

PCT Pub. Date: Sep. 13, 2007

(65) Prior Publication Data

US 2009/0200206 A1 Aug. 13, 2009

Related U.S. Application Data

(60) Provisional application No. 60/778,800, filed on Mar. 3, 2006.

(51) Int. Cl.
*C10G 45/00* (2006.01)

(52) U.S. Cl.
USPC ..... 208/222; 208/240; 208/243; 208/244; 208/208

(58) Field of Classification Search
USPC ..... 208/3, 222, 212
See application file for complete search history.

(56) References Cited

U.S. PATENT DOCUMENTS

| | | | | |
|---|---|---|---|---|
| 4,746,420 | A | 5/1988 | Darian et al. | |
| 5,958,224 | A | 9/1999 | Ho et al. | |
| 6,042,719 | A | 3/2000 | Shih | |
| 6,160,193 | A | 12/2000 | Gore | |
| 6,402,940 | B1 | 6/2002 | Rappas | |
| 7,686,947 | B2 | 3/2010 | Cholley et al. | |
| 2003/0010674 | A1 | 1/2003 | Hagen et al. | |
| 2003/0075483 | A1 | 4/2003 | Stanciulescu et al. | |
| 2003/0111389 | A1 | 6/2003 | Johnson et al. | |
| 2004/0035753 | A1 | 2/2004 | Cullen | |
| 2004/0104144 | A1 * | 6/2004 | Hagen et al. | 208/3 |
| 2004/0262200 | A1 | 12/2004 | Sughure et al. | |
| 2005/0150819 | A1 * | 7/2005 | Wachs | 208/208 R |
| 2005/0189261 | A1 | 9/2005 | Briot et al. | |
| 2006/0180501 | A1 | 8/2006 | Da Silva et al. | |
| 2007/0051667 | A1 * | 3/2007 | Martinie et al. | 208/208 R |

FOREIGN PATENT DOCUMENTS

| | | | |
|---|---|---|---|
| EP | 482841 | A1 | 4/1992 |
| EP | 0565324 | A1 | 10/1993 |
| JP | 2001-354978 | | 12/2001 |
| JP | 2004-195445 | | 7/2004 |
| JP | 2004-196927 | | 7/2004 |
| WO | 02/074884 | A1 | 9/2002 |
| WO | 03/051798 | A1 | 6/2003 |
| WO | 2005/066313 | A2 | 7/2005 |

OTHER PUBLICATIONS

Martinie et al.: "Investigation of the Wet Oxidation Efficiencies of Perchloric Acid Mixtures for Various Organic Substances and the Identities of Residual Matter", Analytical Chemistry, vol. 48, Jan. 1976, pp. 70-72.

Stec Z et al.: "Oxidation of sulfides with H202 catalized by Na2W04 under phase-transfer conditions", Polish Journal Of Chemistry, Polskie Towarzystwo Chemiczne, PL, vol. 70, Jan. 1, 1996, pp. 1121-1123.

Ma et al.: "Determination of sulfur compounds in non-polar fraction of vacuum gas oil", Fuel, vol. 76, No. 4, 1997, pp. 329-339.

Borah et al.: "Oxidation of high sulphur coal. Part 2. Desulphurisation of organic sulphur by hydrogen peroxide in presence of metal ions", Fuel, 80(10), 2001, pp. 1475-1488.

Te M et al.: "Oxidation reactivities of dibenzothiophenes in polyoxometaiate/H202 and formic acid/H202 systems", Applied Catalysis A: General, Elsevier Science, Amsterdam, NL, vol. 219, No. 1-2, Oct. 5, 2001, pp. 267-280.

Hu et al.: "Rigorous hydrotreater simulation" PTQ Spring 2002, pp. 85-91.

Levy: "Unipure's Oxidative Desulfurization Process Creates New Market Opportunities for Supply of Ultra-Low Sulfur Fuels", 2003, pp. 1-8.

Mei H et al.: "A new method for obtaining ultra-low sulfur diesel fuel via ultrasound assisted oxidative desulfurization", Fuel, Ipc Science and Techlogy Press, Guildford, GB, vol. 92, No. 4, Mar. 1, 2003, pp. 405-414.

(Continued)

*Primary Examiner* — Melvin C Mayes
*Assistant Examiner* — Colette Nguyen
(74) *Attorney, Agent, or Firm* — Abelman, Frayne & Schwab

(57) ABSTRACT

Sulfur-containing compounds, including specifically thiophenic compounds, in a liquid hydrocarbon feedstream are catalytically oxidized by combining the hydrocarbon feedstream with a catalytic reaction mixture that includes a peroxide that is soluble in water or in a polar organic acid, at least one carboxylic acid, and a catalyst that is a transition metal salt selected from the group consisting of $(NH_4)_2WO_4$, $(NH_4)_6W_{12}O_{40}.H_2O$, $Na_2WO_4$, $Li_2WO_4$, $K_2WO_4$, $MgWO_4$, $(NH_4)_2MoO_4$, $(NH_4)_6Mo_7O_{24}.4H_2O$, $MnO_0$ and $NaVO_3$; the mixture is vigorously agitated for a time that is sufficient to oxidize the sulfur-containing compounds to form sulfoxides and sulfones; the reaction mixture is allowed to stand and separate into a lower aqueous layer containing the catalyst and an upper hydrocarbon layer that is recovered and from which the oxidized sulfur compounds are removed, as by solvent extraction, distillation or selective adsorption. The process can be used to reduce the sulfur content of liquid transportation fuels to 10 ppm, or less.

20 Claims, 4 Drawing Sheets

(56) References Cited

OTHER PUBLICATIONS

Noyori R et al.: "Green oxidation with aqueous hydrogen peroxide", Chemical Communications—Chemcom; [60150], Royal Society Of Chemistry, GB, No. 16, Jan. 1, 2003, pp. 1977-1986.
Shiraishi et al.: "Photochemical Production of Biphenyls from Oxidized Sulfur Compounds Obtained by Oxidative Desulfurization of Light Oils", Energy & Fuels, vol. 17, No. 1, 2003, pp. 95-100.
Song et al.: "New design approaches to ultra-clean diesel fuels by deep desulfurization and deep dearomatization", Applied Analysis B: Environmental, 41, 2003 pp. 207-238.
Wang D et al.: "Oxidative desulfurization of fuel oil—Part I. Oxidation of dibenzothiophenes using tert-butyl hydroperoxide", Applied Catalysis A: General, Elsevier Science, Amsterdam, NL, vol. 253, No. 1, Oct. 20, 2003, pp. 91-99.
Yazu et al.: "Tungstophosphoric Acid-catalyzed Oxidative Desulfurization of Light Oil with Hydrogen Peroxide in a Light Oil/Acetic Acid Biphasic System", Chemistry Letters, vol. 32, No. 10, 2003, pp. 920-921.
Zhao: "Selectively oxidative desulfurization of fluid catalytic cracking gasoline", 226TH ACS National Meeting, New York, NY, Sep. 7-11, 2003 (Abstract only).
Campos-Martin J M et al.: "Highly efficient deep desulfurization of fuels by chemical oxidation", Green Chemistry, Royal Society of Chemistry, Cambridge, GB, vol. 6, No. 11, Nov. 1, 2004, pp. 557-562.
Li et al.: "Ultra-Deep Desulfurization of Diesel: Oxidation with a Recoverable Catalyst Assembled in Emulsion", Chem. Eur. J., 10, 2004, pp. 2277-2280.
Ramirez-Verduzco et al.: "Desulfurization of diesel by oxidation/extraction scheme: influence of the extraction solvent", Catalysis Today, 98(1-2), 2004, pp. 289-294.
Shiraishi et al.: "Desulfurization of Vacuum Gas Oil Based on Chemical Oxidation Followed by Liquid-Liquid Extraction", Energy & Fuels, vol. 18, No. 1, 2004, pp. 37-40.
Torres-Garcia et al.: "Influence of surface phenomena in oxidative desulphurization with WOx/ZrO2 catalysts", Applied Physics A, vol. 79, Issue 8, 2004, pp. 2037-2040.
Yazu K et al.: "Oxidative Desulfurization of Diesel Oil with Hydrogen Peroxide in the Presence of Acid Catalyst in Diesel Oill Acetic Acid Biphasic System", Chemistry Letters, Chemical Society of Japan, JP, vol. 33, No. 10, Jan. 1, 2004, pp. 1306-1307.
Deshpande et al.: "Ultrasound-Assisted, Base-Catalyzed Oxidation of 4,6-Dimethyldibenzothiophene in a Biphasic Diesel-Acetonitrile System", vol. 19, No. 1, 2005, pp. 28-34.
Yu et al.: "Oxidative Desulfurization of Diesel Fuels with Hydrogen Peroxide in the Presence of Activated Carbon and Formic Acid", Energy & Fuels, vol. 19, No. 2, 2005, pp. 447-452.
Garcia-Gutierrez J L et al.: "Ultra-deep oxidative desulfurization of diesel fuel with H202 catalyzed under mild conditions by polymolybdates supported on Ai203", Applied Catalysis A: General, Elsevier Science, Amsterdam, NL, vol. 305, No. 1, May 17, 2006, pp. 15-20.
Al-Shahrani et al.: "Desulfurization of diesel via the H202 oxidation of aromatic sulfides to sulfones using a tungstate catalyst", Applied Catalysis B: Environmental, Elsevier, vol. 73, No. 3-4, Apr. 18, 2007, pp. 311-316.
EP Application 07752530.1, Supplementary Search Report, Nov. 30, 2011, pp. 1-10.
CN Application No. 200780016040.3, Office Action, Jan. 13, 2012, pp. 1-17 (including English language translation).
CN Application No. 200780016040.3, Office Action, Sep. 8, 2010, pp. 1-21 (including English language translation).
PCT ISR, WO2007103440 A3, Oct. 1, 2007, pp. 1-3.

* cited by examiner

CATALYTIC PROCESS FOR DEEP OXIDATIVE DESULFURIZATION OF LIQUID TRANSPORTATION FUELS

FIELD OF THE INVENTION

This invention relates to novel catalysts, systems and processes for the reduction of the sulfur content of liquid hydrocarbon fractions of transportation fuels, including gasoline and diesel fuels, to about 10 ppm, or less, by an oxidative reaction.

BACKGROUND OF THE INVENTION

Crude oil of naturally low sulfur content is known as sweet crude and has traditionally commanded a premium price. The removal of sulfur compounds from transportation fuels has been of considerable importance in the past and has become even more so today due to increasingly strict environmental regulations relating to the release of sulfur-containing combustion compounds into the atmosphere.

Sulfur in fossil fuels is highly undesirable because of its potential to cause pollution, i.e., $SO_X$ gases and acid rain. Sulfur also results in the corrosion of metals and the poisoning of the precious metal catalysts that are widely used in the petrochemical industries. The United States Environmental Protection Agency has recommended strict regulations for the sulfur content in the diesel fuel used in the United States. According to these recommendations, the sulfur content in diesel fuel must be reduced from the current level of 500 ppm to 15 ppm during 2006. New regulations in Japan and in Europe require the reduction of sulfur in diesel transportation fuel to 10 ppm during 2007 and 2009, respectively.

Conventional hydrodesulfurization (HDS) processes have been used widely in refineries to transform sulfur-containing compounds mainly to hydrogen sulfide which itself presents a significant health hazard and is corrosive, particularly in the presence of water. When contacted with certain functional catalysts, hydrogen sulfide and other sulfur compounds act as a catalyst poison, that is, the sulfur deactivates or reduces the effectiveness of the catalyst. The breakthrough of sulfur from various sweetening processes results in catalyst poisoning, corrosion of tanks, ships, and pipelines, and can result in economic losses to the refinery from flaring, reinjection for reprocessing, or discounted sales prices for off-spec hydrocarbon products having high sulfur content.

The hydrodesulfurization process involves high temperature, elevated pressure, metal catalysts and large reactors. Apart from being an energy-intensive process, HDS has some inherent problems in the treatment of aromatic hydrocarbon sulfur compounds, such as dibenzothiopene (DBT), and their methylated derivatives, such as 4-methyldibenzothiopene and 4,6-dimethyldibenzothiopene (4,6-DMDBT). These compounds cause steric hindrance because their C—S bond energy is almost equal to the C—H bond energy, which makes them hard to break down by mere hydrotreatment.

An important factor for deep desulfurization is the reactivity of aromatic sulfur compounds. Deep HDS may produce low-sulfur diesel, but ultimately results in higher energy costs and the generation of $CO_2$, which is a greenhouse gas.

HDS processing is not effective in completely removing the refractory sulfur compounds in diesel which are present in the form of n-alkyl benzothiophene and n-alkyl dibenzothiophene, where n is methyl, ethyl, or a mixture of both in different ratios and positions on the phenyl groups. The HDS process is not effective in the so-called deep de-sulfurization or deep removal to 10 ppm, or less by weight.

There are also references in the technical literature to processes for petroleum oil desulfurization. For example, Guth et al. disclose the use of nitrogen dioxides followed by extraction with methanol to remove both nitrogen and sulfur-containing compounds from petroleum feedstocks. (See Guth, E. D. et al., *Petroleum oil desulfurization.* 1975, (KVB Engineering, Inc., USA). Application: US. p. 8 pp.) Tam et al. describe a process for purifying hydrocarbon aqueous oils such as shale oils to remove heteroatoms impurities including nitrogen and sulfur compounds. (See Tam, P. S., Kittrell, J. R., Eldridge, S. W., *Ind. Eng. Chem. Res.* 1990, pp. 29, 321-324) Deshpande et al. disclose that ultrasonic methods can be applied for the intensive mixing of the biphasic system resulting in a reduction of more than 90% of dimethyl dibenzothiophene (DMDBT) contained in diesel fuel samples. (See Deshpande, A., Bassi A. and Prakash A., *Ultrasound-Assisted, Base-Catalyzed Oxidation of* 4,6-*Dimethyldibenzothiophene in a Biphasic Diesel-Acetonitrile System.* Energy & Fuels, 2005. 19(1): p. 28-34.

Yazu et al. have reported that dibenzothiophene can be oxidized effectively with hydrogen peroxide in the presence of 12-tungstophosphoric acid (TPA) in a n-octane/acetonitrile biphasic system to give their corresponding sulfones as the major product.

Liquid-liquid extraction is widely used to separate the constituents of a liquid solution by introducing another immiscible liquid. In the petroleum industry, solvent extraction has been used to remove sulfur and/or nitrogen compounds form light oil. The extracted oil and solvent are then separated by distillation. (See Yazu, K., M. Makino, and K. Ukegawa, *Oxidative desulfurization of diesel oil with hydrogen peroxide in the presence of acid catalyst in diesel oil/acetic acid biphasic system.* Chemistry Letters, 2004. 33(10): p. 1306-1307); Yazu, K., et al., *Tungstophosphoric acid-catalyzed oxidative desulfurization of light oil with hydrogen peroxide in a light oil/acetic acid biphasic system.* Chemistry Letters, 2003. 32(10): p. 920-921; Yazu, K., et al., *Oxidation of Dibenzothiophenes in an Organic Biphasic System and Its Application to Oxidative Desulfurization of Light Oil.* Energy & Fuels, 2001. 15(6): p. 1535-1536.

The processes of the prior art as reported in the literature are complex and present operational difficulties when practiced on an industrial scale. It has been shown that the oxidative desulfurization process using $H_2O_2$ or a related agent as the oxidant can be realized using either a heterogeneous or a homogeneous catalyst. A heterogeneous catalyst cannot contact the feedstock mixture of $H_2O_2/H_2O$ and the transportation fuel uniformly even in a fluidized bed reactor, since they exist in separate phases. Contact may catalyze the decomposition of $H_2O_2$ before it can react with the sulfur. The most commonly reported homogenous catalyst systems for efficiently promoting ODS are heteropolyanion catalysts. Heteropolyanion catalysts need a special medium to stabilize the catalyst and this type of catalyst is relatively expensive.

Despite the disclosure of numerous processes in the prior art, these processes have failed to provide low sulfur hydrocarbon fuels in an efficient and economical manner. Catalyst-based processes disclosed in the prior art employ catalysts that are complex, expensive to produce, and that are not recyclable. The use of these catalysts and processes for the mandated reduction in sulfur levels which are characterized as deep desulfurization, will be expensive to practice and will necessarily add to the cost of the transportation fuels. The use of complex, unstable and expensive catalyst compounds and systems that are non-regenerable and that can involve hazards in their disposal are less than desirable.

It is therefore an object of the present invention to provide a catalyst and process for deep desulfurization that produces essentially sulfur-free hydrocarbons with a chemically simple, inexpensive and reusable catalyst in a system that is highly efficient at low temperature and pressure.

It is another object of the invention to provide a process and catalysts that are efficient and economical for use on an industrial scale to achieve the deep desulfurization of such difficult to remove petroleum fuel components as the benzothiophenes and di-benzothiophenes.

It is a further object of the invention to provide a catalyst for use in the desulfurization process that is both robust and that can be readily regenerated and recycled for repeated subsequent uses in the desulfurization process.

Another object of the invention to provide an improved catalyst-based process that can be installed downstream of the HDS unit for the deep desulfurization of liquid distillate fuels.

SUMMARY OF THE INVENTION

The process of the invention broadly comprehends a novel two-stage catalytic reaction scheme in which the sulfur-containing compounds in the feedstock are oxidized to form sulfoxides and sulfones by a selective oxidant and the sufoxides and sulfones are preferentially extracted by a polar solvent.

The formation of the sulfone and sulfoxide compounds is accomplished using a per-acid oxidizing agent with a transition metal oxide catalyst. The preferred catalyst compounds are $(NH_4)_2WO_4$, $(NH_4)_6W_{12}O_{40}.H_2O$, $Na_2WO_4$, $Li_2WO_4$, $K_2WO_4$, $MgWO_4$, $(NH_4)_2MoO_4$, $(NH_4)6Mo_7O_{24}.4H_2O$, $MnO_o$ and $NaVO_3$. The catalysts and process of the invention are useful in effecting sulfur removal from hydrocarbon fuel fractions, including diesel fuel and gasoline. The method of the invention can also be applied to reduce the sulfur content of unfractionated whole crude oil.

This catalyst system and process of the invention can reduce the sulfur content in liquid transportation fuels to less than 10 ppm w/w. A transition metal oxide catalyst in organic acid media and with an oxidizing agent removes such sulfur-containing compounds as thiopene, n-alkyl benzothiophene (BT), n-alkyl dibenzothiophene (DBT), where n can be methyl, ethyl, or a mixture of both at different ratios and at different positions on the phenyl groups, and other sulfur species present in petroleum-based transportation fuels. This milky phase reaction involves oxidation of sulfur-containing compounds into their corresponding oxides. The reaction takes place from ambient temperatures to 200° C. and from ambient pressure to 100 bars. The separation of the oxidized sulfur compounds is easily accomplished due to the formation of two distinct layers.

The sulphoxides and sulphones formed can be extracted by conventional and readily available polar solvents, such as methanol and acetonitrile.

As used in this description of the invention, the term "biphasic" refers to (1) the liquid hydrocarbon or fuel portion and (2) the aqueous mixture of acid(s) and oxidizing agent(s) portion. These portions can be intimately mixed to form what appears to be an homogenized condition; upon standing, two layers will form.

The preferred oxidizing agents are $H_2O_2$, aqueous solutions of organic peroxides and polar organic acid-soluble organic peroxides. The concentration of the peroxide is from 0.5% to 80% by weight, and preferably from 5% to 50% by weight. The organic peroxide can be an alkyl or aryl hydrogen peroxide, or a dialkyperoxide or diarylperoxide, where the alkyl or aryl groups can be the same or different. Most preferably, the organic peroxide is 30% hydrogen peroxide. It is to be understood that all references in this description of the invention are to percentage by weight, or weight percent.

The preferred polar organic solvent is selected from the group consisting of methanol, ethanol, acetonitrile, dioxin, methyl t-butyl ether, and mixtures thereof. The extraction solvent or solvents are selected for desulfurization of specific fuels. Solvents are to be of sufficiently high polarity, e.g. having a delta value greater than about 22, to be selective for the removal of the sulfones and sulfoxides. Examples of suitable solvents include, but are not limited to the following, which are listed in the ascending order of their delta values: propanol (24.9), ethanol (26.2), butyl alcohol (28.7), methanol (29.7), propylene glycol (30.7), ethylene glycol (34.9), glycerol (36.2) and water (48.0)

In additional to polarity, other properties to consider in selecting the extraction solvent include boiling point, freezing point, and surface tension. In the preferred embodiment of this invention, the polar organic solvents are selected from the group consisting of methanol, ethanol, acetonitrile, dioxin, methyl t-butyl ether, and mixtures thereof.

Sulfur in particular is known to have a higher polarity value than sulfur compounds from which they are derived via the oxidation process. In this case, they would most likely reside in the aqueous phase in a form of emulsion and also as a precipitate. Minimal amounts of sulfones still emulsified in the upper hydrocarbon layer are readily washed out by water or any of the above-mentioned polar solvents. Centrifugation can be used to complete the physical separation of the aqueous layer from the upper hydrocarbon layer.

The invention thus comprehends the use of new and yet chemically simple catalyst compounds. The process of the invention is easy to control, economical, and very efficient at relatively low temperatures and pressures, thereby providing the advantage of operating in ranges that are not severe.

BRIEF DESCRIPTION OF THE DRAWINGS

The invention will be further described below and with reference to the attached drawings in which.

DETAILED DESCRIPTION OF THE INVENTION

Figure 1:
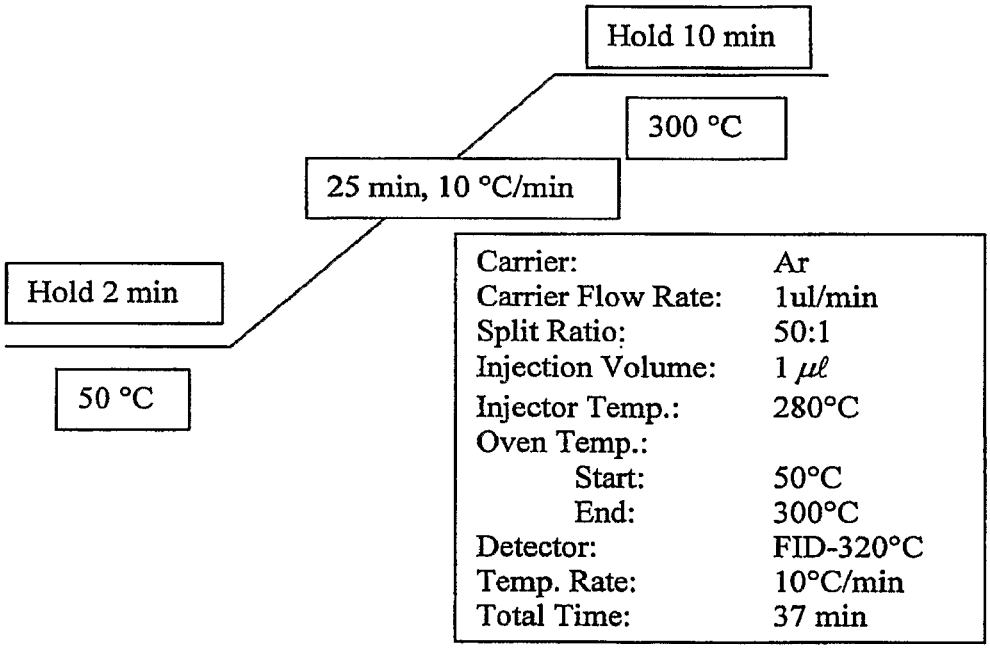
FIG. 1 is a schematic illustration of a time/temperature operational protocol for a gas chromatograph used in the analyses of product samples prepared in the practice of the invention.

The novel process broadly comprehends the biphasic (as defined above) oxidative reaction and extraction employing finely dispersed transition metal catalysts in a sulfur-containing liquid hydrocarbon to promote the oxidation to sulfones and sulfoxides of the sulfur in benzothiophene compounds, followed by the polar phase extraction of the oxidized sulfones and sulfoxides, thereby providing deep sulfur removal from the fuel.

In the practice of the process of the invention, a sulfur-containing liquid transportation fuel stock is intimately mixed with a solid catalyst formulation in the form of a polar slurry mixed with $H_2O_2/H_2O$, or other aqueous peroxides, and which is easily dispersed in the transportation fuel. The active component is highly dispersed in the polar system, which is believed to form a stable transition metal peroxide complex-containing intermediate. This intermediate can "travel" in the oil phase easily during stirring to catalyze oxidation of the sulfur-containing compounds and convert them into a sulfone or sulfoxide, which is then extracted by the polar slurry phase. This method uses a homogeneous catalyst dispersed in the polar phase. The separation of the catalyst from the products can be easily achieved by simple phase decantation or by centrifugation, if desired.

In one preferred embodiment, 1-2 weight % of a dispersible transition metal oxide, 0.5-1 weight % of oxidizing agent, for example, peroxides, in less than 5% organic acid, are thoroughly mixed with a hydrotreated liquid transportation fuel, such as diesel or gasoline (i.e., the oil phase), in order to oxidize the sulfur-containing compounds to form their corresponding sulfoxides and sulfones. The oxidation process can be conducted in either continuous flow or batch reactors. The reaction proceeds efficiently from as low as ambient temperature and pressure to 200° C. and 100 bars.

The oxidant in this process is chosen from $H_2O_2$, or aqueous or polar organic acid-soluble organic peroxides. The concentration of peroxide can be from 0.5% to 80%, preferably from 5% to 50% by weight. The organic peroxide can be alkyl or aryl hydroperoxide, or a dialky or diarylperoxide, where the alkyl or aryl groups can be the same or different, and preferably the organic peroxide is 30% hydrogen peroxide. Suitable compounds include tertiary-butyl hydroperoxide, $(CH_3)_3COOH$, cumyl hydroperoxide, $C_9H_{12}O_2$; and di-tertiary-butyl peroxide, $C_8H_{18}O_2$ and dicumyl peroxide, $[C_6H_5C(CH_3)_2O]_2$, among others.

Mixing the oxidant phase, e.g., $H_2O_2$ or other peroxide, one or more carboxylic acids, with or without the other organic solvent, and a transition metal salt, forms the polar phase system. The carboxylic acid can be formic acid, acetic acid, propionic acid, or other longer-chain carboxylic acids. The carbon number can be from 1 to 20, and is preferably from 1 to 4.

The transition metal salt is chosen for its ability to form a slurry, or milky phase, in the polar solvent systems which appears more as a homogeneous phase, rather than a heterogeous phase. The transition metal oxo-salt can be $(NH_4)_2WO_4$, $(NH_4)_6W_{12}O_{40}.H_2O$, $Na_2WO_4$, $Li_2WO_4$, $K_2WO_4$, $MgWO_4$, $(NH_4)_2MoO_4$, $(NH_4)6Mo_7O_{24}.4H_2O$, $MnO_o$ and $NaVO_3$, and mixtures thereof. A suitable transition metal oxide catalyst for use in the process of the invention forms a slurry or milky phase with the polar solvent.

Upon standing, two immiscible layers are formed, e.g., the oil phase and the polar phase. The fuel recovery rate is greater than 95%. A substantially complete recovery of the fuel can be projected upon scale-up of the process and separation equipment. With more than a 95% recovery rate, the upper non-polar phase consists principally of treated liquid fuel containing less than 10 ppm of sulfur. The lower milky layer contains the newly-formed oxidized sulfur compounds dissolved in the organic acid, the oxidizing agent and the catalyst. The lower layer can readily be physically separated and washed with any conventional polar solvent, such as methanol or acetonitrile, in order to remove the sulfur-containing compounds. The catalyst can be recovered by filtration, washed, if necessary, and used again in subsequent oxidation reactions.

This oxidative process reaction can be carried out at temperatures ranging from 10° to 200° C., preferably from 50° to 90° C. and is operable from ambient pressure to 100 bars, and preferably is carried out at a pressure from 1 to 10 bars. Under appropriate conditions, the reaction can be completed in 30 minutes, or less.

Stirring is preferable throughout the reaction to form the desired medium and to homogenize the mixture for the reaction to proceed efficiently and effectively to completion, e.g., to a reduced sulfur content of 10 ppm or less. Conventional laboratory stirring, heating and temperature control apparatus was used in the examples that are described below.

The reaction products are principally oxygenated thiophenic compounds such as sulfones and sulfoxides. In the second step of the process of the invention, the extraction of the dissolved oxygenated thiophenic compounds is accomplished with high efficiency by the use of polar solvents such as acetonitrile, methanol, ethanol, dioxin, methyl t-butyl-ether, or their mixtures. Alternatively, since the oxygenated sulfur products obtained have higher polarity and/or molecular weight, they are readily separated from the liquid fuels by distillation, or by solvent extraction methods, or by selective adsorption, all of which processes are well known to those of ordinary skill in the art.

The process of the invention can be advantageously introduced downstream of existing hydrodesulfurization (HDS) units in order to reduce any remaining refractory sulfur compounds to a content that is 10 ppm or less.

Most of the prior art catalysts known to and used in the art are complex, expensive to produce and non-recyclable. In contrast, the catalysts used in the process of the present invention are not complex, and are robust, economical and can be readily regenerated and recycled. The novel process and catalysts of the invention provide an efficient and cost-effective process for deep removal of sulfur-containing compounds from liquid distillate fuels.

This highly efficient biphasic catalysis system, and the ease of separation of the catalyst makes it possible for the oxidative desulfurization process of this invention to be used on an industrial scale.

The invention will be further described in conjunction with the results of tests that are representative of various embodiments. As will be apparent to those of ordinary skill in the art, various modifications and substitutions can be made that are within the scope of the invention. A general description of the laboratory-scale tests follows.

The following examples describe the stepwise procedure for practicing the oxidative extractive desulfurization (OEDS) process of the invention. Also described are tests using both a prepared sample, or model feed, and an actual commercial diesel fraction sample. In these examples, the organic chemicals used in preparing the test compositions were purchased from Aldrich Chemicals Company, Inc. of Milwaukee, Wis., USA, unless otherwise indicated.

In some examples, the "% conversion" is reported, the value being calculated as follows:

$$\%\ \text{Conversion}=(Co-Ct)/C_o\times 100$$

where $C_o$ is the initial concentration of the sulfur compound(s) and $C_t$ is the concentration measured at a specified period of time after the beginning of the oxidation reaction.

In the following examples, the oxidized compounds and solvent in the aqueous layer were separated from the hydrocarbon upper layer, either by gravity separation, alone, or in combination with centrifugation.

Example 1

Preparation of a Standard Thiophene Compound—DBT/n-$C_8$

One gram of 98% dibenzothiophene was dissolved in 99% n-octane (n-$C_8$) in a 500 ml volumetric flask with gentle stirring and shaking. This solution had a sulfur content of 495 ppmw and was used as the internal standard.

Example 2

Oxidative Reaction of the Standard Thiophene Compound

The oxidative test of this example used the standard compound DBT/n-$C_8$ prepared in Example 1. This test was carried out in a 250 ml round bottom flask immersed in a thermostatically controlled bath and equipped with a condenser, thermometer and magnetic stirrer.

A solution of 50 ml of DBT/n-$C_8$ was added to 0.2 g of 98% sodium tungstate di-hydrate (STDH), 0.5 ml of 30% hydrogen peroxide ($H_2O_2$) and 5 ml glacial acetic acid ($CH_3CO_2H$) was homogenized in the flask with stirring and heating starting at 30° C. with incremental temperature increases of 20° C. up to 110° C. The temperature was maintained for 30 minutes at each 20° C. interval from 30° C. to 110° C., and the total reaction time was 150 minutes. Starting at as low as 50° C., a lower milky layer was formed. Small aliquots of samples were carefully withdrawn from both upper and lower layers at the end of each 30-minute time interval and each 20° C. temperature interval in order to plot the kinetics of the oxidative reaction. After oxidation, the mixture was decanted into a centrifugation tube and centrifuged at 3000 rpm for from 5 to 10 minutes using a Denley BS 400 centrifuge. The two layers were then physically separated using a separatory funnel.

The collected samples were analyzed by gas chromatography in a Varian 3400 GC equipped with a capillary column DB-1 (L-25 mm, ID-0.22 mm, FT-1.0 μm) bonded with dimethyl polysiloxane as a stationary phase. This non-polar phase is suitable for routine laboratory analysis. The GC was programmed for operation as illustrated schematically in FIG. 1. The sample was heated and held at 50° C. for two (2) minutes; the temperature was raised over twenty-five minutes at the rate of 10° C. per minute to a final temperature of 300° C. The final reading was taken after two (2) minutes at 300° C. The other relevant conditions are set forth in FIG. 1

Product identification was based on standard compounds. The GC-FID results are reported in Table I.

TABLE I

| Compounds | Temp (° C. ) | Layer | RT | Area/10000 |
|---|---|---|---|---|
| DBT Peak | 30 | Upper | 24 | 853 |
| | 50 | Upper | 24 | 224 |
| | 70 | Upper | 24 | 44 |
| | 90 | Upper | 24 | 12 |
| | 110 | Upper | 24 | 1 |
| Sulfone/Sulfoxide Peak | 110 | Lower | 27 | 958 |

As can be seen from the results reported in Table 1, the amount of sulfur in the DBT was reduced over 800-fold, i.e., the sulfur was substantially eliminated from the sample and was converted to sulfone/sulfoxide compounds.

The following examples will demonstrate that the activity of the used STDH catalyst is sufficient to permit it to be recycled and used several times without regeneration.

Example 3

Testing of Recycled Used Catalyst Activity

Two layers were observed as a result of the reactions described in Example 2. The upper layer was composed of the sulfur-containing fuel sample (DBT/n-$C_8$) which has a very low remaining amount of DBT. After a physical separation of this layer, it was found that the volume recovered was more than 98% without significant loss of the fuel. The lower layer, which is milky in appearance, is about 2.8 ml in volume and consists mainly of the dissolved catalyst with the remainder being the acetic acid and hydrogen peroxide (first round).

The activity of the catalyst from Example 2 was further tested in this example.

The lower layer was topped up to 5 ml by adding 2.2 ml of acetic acid and 0.5 ml $H_2O_2$ and with addition of 50 ml of fresh prepared standard sample (DBT/n-$C_8$) in a clean round bottom flask. The mixture was stirred and the temperature gradually increased to 90° C. The reaction proceeded as previously observed and as described above. The upper layer from the previous test was recovered totally without any measurable volumetric loss of the fuel sample. The lower layer consisting of 3 ml of solution containing catalyst was recovered and was used for the third round of testing, as described below (second round).

Example 4

Continued Testing of Used Catalyst Activity

The activity of the catalyst recovered from the sample of Example 3 was further tested.

The 3 ml recovered from the lower layer of the previous example was topped up by adding 2 ml of AcOH, 0.5 ml of $H_2O_2$ and 50 ml of fresh DBT/n-$C_8$. The upper layer was removed and retained after reaching 90° C. and the lower layer was found to contain 3.3 ml that will be used in a further test of catalyst activity as described below (third round).

Example 5

Further Test of Used Catalyst Activity

The activity of the catalyst from Example 4 was further tested.

The 3.3 ml recovered from the lower layer of Example 4 was topped up by adding 1.7 ml AcOH, 0.5 ml $H_2O_2$ and 50 ml of fresh DBT/n-$C_8$. After GC analysis of the products collected as in the previous examples, it appeared that the catalyst was not as active as in the previous rounds. In order to confirm the accuracy of this conclusion, the further test of Example 6 was performed (fourth round).

Example 6

In order to confirm the apparent reduction in the activity of the catalyst from Example 5, fresh catalyst was added in this example.

Addition of 0.1 g of STDH to the lower layer from the fourth round and 0.5 ml $H_2O_2$ with stirring and incremental heating to 90° C. was performed as described as in prior examples. The analytical result showed substantially complete conversion of the DBT to its sulphones or sulphoxides, DBTS.

This confirmed the preliminary conclusion from the fourth round GC results of Example 5 that the catalyst was not as active as in the previous tests.

The GC results from Examples 2-6 are shown in the summary of Table II and confirm that the catalyst remains active after three reaction batches. Note that catalyst was added in Example 6.

TABLE II

| Round/Example | DBT Peak Area/1000 | DBTS Peak Area/1000 |
|---|---|---|
| First/02 | 66 | 1167 |
| Second/03 | 229 | 1207 |
| Third/04 | 1328 | 1597 |
| Fourth/05 | 4438 | 1824 |
| Catalyst Added/06 | 918 | 34 |

In the previous examples, the catalyst system was composed of STDH, $H_20_2$ and acetic acid (AcOH) as the reaction media. In the following series of examples, different media were tested in place instead of AcOH with the same amount of STDH and $H_20_2$ and under the same reaction conditions.

In the following examples, the carboxylic acid, i.e., acetic acid, that was used in Examples 2-6 was replaced by a variety of other compounds, each representative of a broader class of chemical compounds. The conclusion for compounds tested in Examples 7 through 12 was negative as indicated by the GC results.

General Procedure

In each of the following examples, 50 ml of DBT/n-$C_8$, 0.2 gm of STDH, 1 ml of $H_2O_2$ were added to a 250 ml round bottom flask along with 5 ml of the medium that replaced acetic acid used in the previous series of tests.

The mixture was stirred, with incremental heating at 20° C. intervals for 30 minutes, and testing of aliquots from 30° C. to 70° C., in the manner described for Example 2, above.

| Example | Class | Compound |
|---|---|---|
| 7 | Alcohol | Methanol |
| 8 | Nitrites | Acetonitrile |
| 9 | Glycols | Dipropylene glycol |
| 10 | Ketone | Acetone |
| 11 | Aldehyde | Formaldehyde |

Example 7

Testing Alcohol in Place of Acids for ODS

In this test, 50 ml of DBT/n-$C_8$ standard of Example 1 was added to 5 ml of methanol in the presence of 0.2 g of STDH and 1 ml of $H_20_2$ and mixed in a round bottom flask. The addition started at 30° C. with stirring to 70° C. Test results indicated no prospect for using alcohols in place of acids as a media for the ODS reaction.

Example 8

Testing Nitriles in Place of Acids for ODS

In this test, 50 ml of DBT/n-$C_8$ was added to 5 ml of acetonitrile in presence of 0.2 g of STDH and 1 ml of $H_20_2$ in a round bottom flask. The temperature of the mixture started at 30° C. with stirring to 70° C. Test results indicated no prospect for using nitriles in place of acids as a media for the ODS reaction.

Example 9

Testing Glycols in Place of Acids for ODS

In this test, 50 ml of DBT/n-$C_8$ was added to 5 ml of dipropylene glycol (DPG) in the presence of 0.2 g of STDH and 1 ml of $H_20_2$ in a round bottom flask. The experiment started at 30° C. with stirring to 70° C. Test results indicated no prospect for using glycols in place of acids as a media for the ODS reaction.

Example 10

Testing Acetone in Place of Acids for ODS

In this test, 50 ml of DBT/n-$C_8$ was added to 5 ml of acetone in presence of 0.2 g of STDH and 1 ml of $H_20_2$ in a round bottom flask. The experiment started at 30° C. with stirring to 70° C. Test results indicated no prospect for using ketones in place of acids as a media for the ODS reaction.

Example 11

Testing Formaldehyde in Place of Acids for ODS

In this test, 50 ml of DBT/n-$C_8$ was added to 5 ml of formaldehyde in presence of 0.2 g of STDH and 1 ml of $H_20_2$ in a round bottom flask. The experiment started at 30° C. with stirring to 70° C. Test results indicated no prospect for using aldehydes in place of acids as a media for the ODS reaction.

Example 12

Testing Other Acidic Compounds for ODS 50 ml of DBT/n-$C_8$ was added to 5 ml of propionic acid instead of acetic acid in presence of 0.2 g of STDH and 1 ml of $H_20_2$ in a round bottom flask. The mixture started at 30° C. with stirring to 70° C. and test results showed the ODS reaction works in this acidic media.

The following examples are provided to demonstrate the testing of other catalyst materials for activity in the process of the invention.

Example 13

Testing Sodium Molybdate (VI) as an ODS Metal Catalyst

In a round bottom flask, 50 ml of DBT/n-$C_8$ was added to 0.2 g of sodium molybdate (VI) dihydrate (SMDH) in presence of 5 ml AcOH and 1 ml of $H_20_2$ with stirring and heating to 90° C. The results of GC indicate that SMDH to be effective as an ODS transition metal catalyst.

Example 14

Testing Manganese Oxide as an ODS Metal Catalyst

In a round bottom flask, 50 ml of DBT/n-$C_8$ was added to 0.2 g of manganese oxide (MnO) in presence of 5 ml AcOH and 1 ml of $H_20_2$ with stirring and heating to 90° C. The MnO was shown by GC to have utility as an ODS transition metal catalyst with a conversion rate of about 15%.

Example 15

Testing Molybdenum Oxide as an ODS Metal Catalyst

In a round bottom flask, 50 ml of DBT/n-$C_8$ was added to 0.2 g of molybdenum oxide ($MoO_2$) in presence of 5 ml AcOH and 1 ml of $H_2O_2$ with stirring and heating to 90° C. The results of GC indicate that $MoO_2$ is effective as an ODS transition metal catalyst.

Example 16

Testing Cobalt Acetate as an ODS Metal Catalyst

In a round bottom flask, 50 ml of DBT/n-$C_8$ was added to 0.2 g of cobalt acetate (CoAc) in the presence of 5 ml AcOH and 1 ml of $H_2O_2$ with stirring and heating to 90° C. The CoAc failed to convert the DBS and was not further considered as a candidate for an ODS transition metal catalyst reactions.

Example 17

Testing Vanadium Oxide as an ODS Metal Catalyst

In a round bottom flask, 50 ml of DBT/n-$C_8$ was added to 0.2 g of vanadium oxide ($V_2O_5$) in the presence of 5 ml AcOH and 1 ml of $H_2O_2$ with stirring and heating to 90° C. The $V_2O_5$ failed to convert the starting material and was not further considered as a candidate for an ODS transition metal catalyst.

Example 18

Testing Sodium Vanadate as an ODS Metal Catalyst

In a round bottom flask, 50 ml of DBT/h-$C_8$ was added to 0.2 g of sodium meta vanadate ($NaVO_3$) in the presence of 5 ml AcOH and 1 ml of $H_2O_2$ with stirring and heating to 90° C. The $NaVO_3$ successfully converted about 19% of the starting material and can be considered as having utility as an ODS transition metal catalyst.

Preparation of Standard Dimethyldibenzothiophene (DMDBT)

In the following examples, the catalytic activity of compounds shown above to be effective will be tested. A standard solution of DMDBT was prepared as follows.

One gram of 4,6-dimethyl dibenzothiophene (DMDBT) 98% purchased from Aldrich was homogenized in n-octane, 99%) also purchased from Aldrich, in a 500 ml volumetric flask with gentle stirring and shaking. This solution had a 215 ppmw sulfur content.

Example 19

Sodium Tungstate Oxidation of DMDBT

As demonstrated in Example 2, STDH with $H_20_2$ and acid readily converts DBT to its DBTS. In the following example, the effect of the STDH catalyst on the standard DMDBT prepared as described above will be demonstrated. It is well known in the art that it is difficult to remove DMDBT by conventional HDS due it high steric hindrance.

In this test, 50 ml of DMDBT/n-$C_8$ was added to 0.2 g of STDH in presence of 0.5 ml $H_20_2$ and 5 ml acetic acid. They were all mixed together in a 250 ml round bottom flask under condenser and with continuous stirring. The temperature was raised incrementally from 30 to 90° C.

The observed results were deemed remarkable. As it has been reported in the literature, DMDBT is more easily removed by ODS than HDS. In this run, almost complete conversion of DMDBT to its sulfones or sulfoxides (DMDBTS) at only 50° C. was observed. No peaks at all were detected at 90° C., which is a strong indication that DMDBT and its corresponding sulfur compounds originally in the fuel were totally converted. The results are summarized in Table III.

TABLE III

| Temperature ° C. | DMDBT (RT = 25.85) Area/1000 | DMDBTS (RT = 28.50) Area/1000 |
|---|---|---|
| 30 | 6703 | 2021 |
| 50 | 863 | 301 |
| 70 | 32 | 218 |
| 90 | No peak | No peak |

Example 20

Oxidative Reaction Using a Commercially Produced Diesel Sample

In this example, the test with the catalyst of Example 2 is described. The same procedure is applied in the following examples using the actual hydrotreated Arabian diesel taken from a refinery, unless otherwise specified.

The test was carried out in a 250 ml round bottom flask immersed in an oil bath and equipped with a condenser, electronic thermometer and a magnetic stirrer. A mixture of 0.2 g of sodium tungstate di-hydrate was mixed with 50 ml of the internal standard, and 5 ml of acetic acid and 0.5 ml of hydrogen peroxide were added at room temperature. The progress of the reaction was monitored as the temperature was increased at 20° C. intervals and maintained for 30 minutes up to 90° C. Reaction samples were collected from the separated upper and lower layers at the end of each time interval. The lower layer appeared milky at 50° C. due to the oxidation reaction between the sulfur constituent and hydrogen peroxide.

Figure 3:
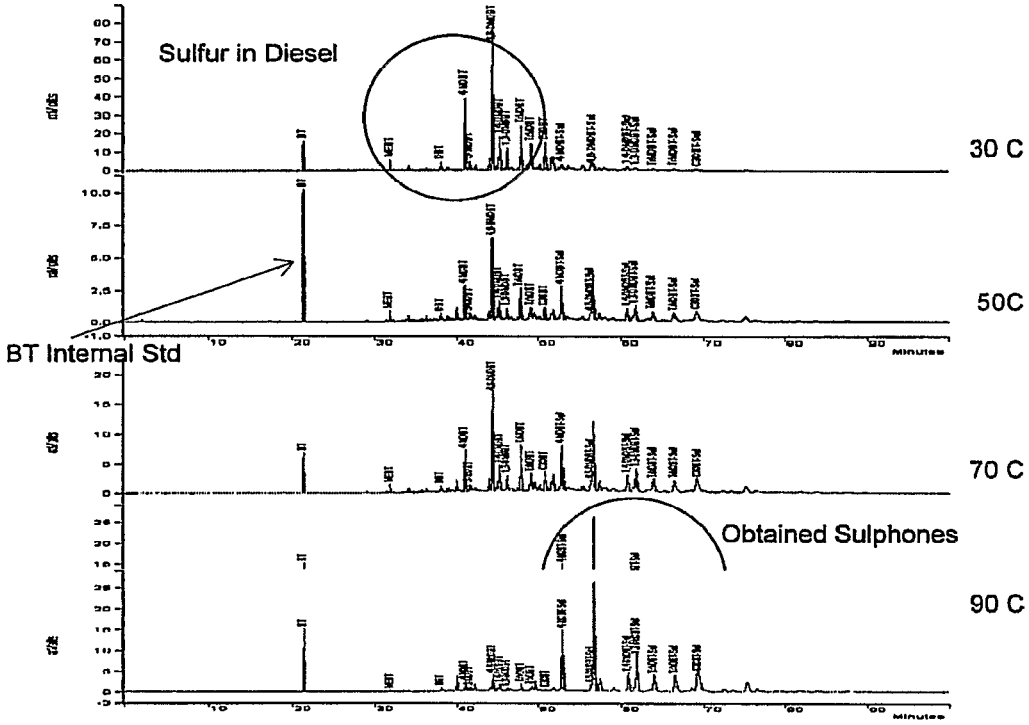
FIG. 3 is a series of gas chromatograms prepared on test samples.

The chromatograms of FIG. 3 show clearly that all of the sulfur-containing compounds in the diesel sample were converted into their corresponding oxygenated sulfones and sulfoxides.

A further summary of the data collected is provided in the following Table IV which shows the conversions at increasing temperatures for the catalysts tested. This data was based on the peak areas of GC-FID chromatograms.

TABLE IV

| | Sulfur % conversion | | | |
|---|---|---|---|---|
| Catalyst | 30° C. | 50° C. | 70° C. | 90° C. |
| $(NH_4)_2WO_4$ | 0 | 94 | 100 | 100 |
| $Na_2WO_4$ | 0 | 79 | 99 | 100 |
| $Li_2WO_4$ | 0 | 97 | 100 | 100 |
| $K_2WO_4$ | 0 | 99 | 100 | 100 |
| $MgWO_4$ | 0 | 19 | 100 | 100 |
| $(NH_4)_2MoO_4$ | 0 | 50 | 81 | 100 |

TABLE IV-continued

| Catalyst | Sulfur % conversion 30° C. | 50° C. | 70° C. | 90° C. |
|---|---|---|---|---|
| MoO2 | 0 | 33 | 81 | 99 |
| $Na_2MoO_4$ | 0 | 19 | 64 | 97 |
| $NaVO_3$ | 0 | 2 | 12 | 19 |
| MnO | 0 | 3 | 11 | 17 |
| Co $(CH_3COO)_2$ | 0 | 1 | 4 | 7 |
| V2O5 | 0 | 2 | 3 | 4 |

Figure 2:
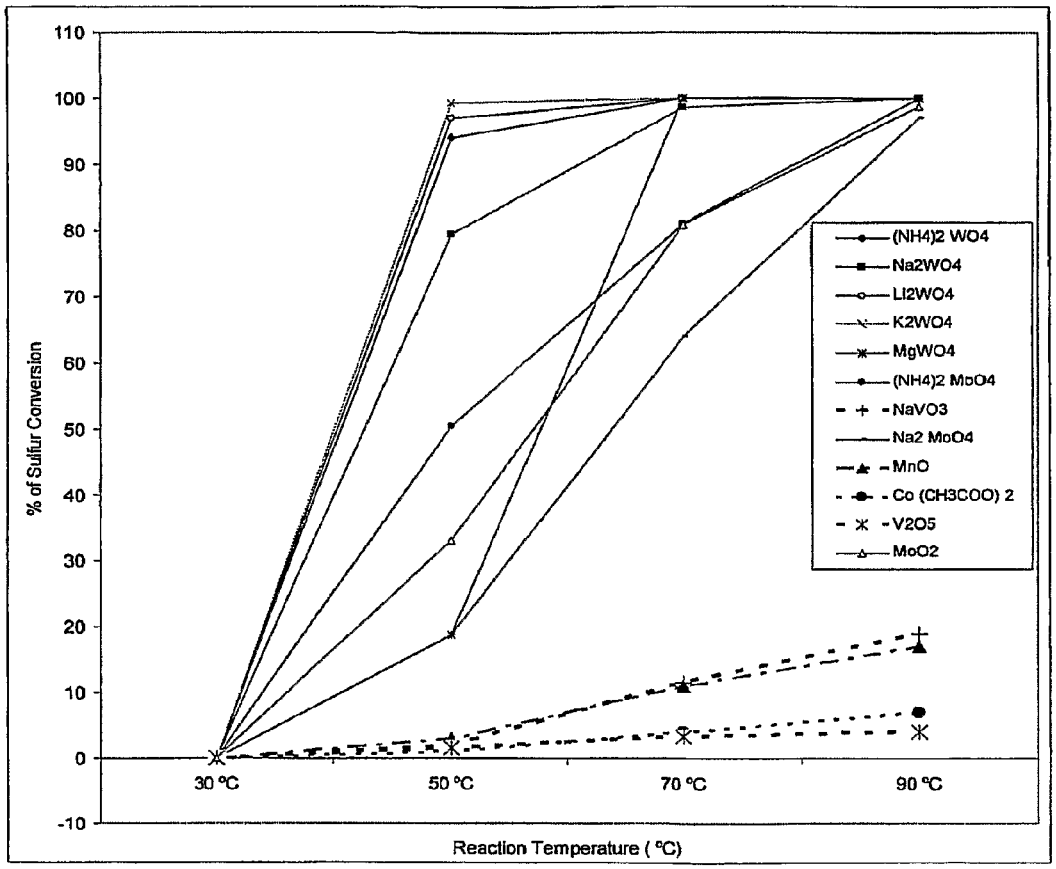
FIG. 2 is a graphic representation of sulfur conversion vs. temperature for various catalysts.

Further information concerning the effectiveness of the various catalysts tested is shown graphically in FIG. 2, in which the percent of sulfur conversion is plotted against the temperature for various ODS catalysts.

Example 21

Extraction of the Newly-Formed Oxygenated Sulfur Compounds

Most of the newly-formed oxygenated sulfones and sulfoxides were in the lower acetic acid layer with the catalyst and are easily removed by separation of the layers. The upper layer contained only diesel with a small portion of the newly-formed oxygenated sulfones and sulfoxides and was washed with a polar solvent to remove the impurities in the diesel. Methanol was used in this example. It has a density of 0.79 g/cc; a typical diesel fuel having an API value of 25-45 has a density of from 0.82 to 0.91 g/cc measured at 15° C. Once mixed, methanol will form the upper clear layer that can be separated using a separatory funnel from lower diesel layer.

Figure 4:
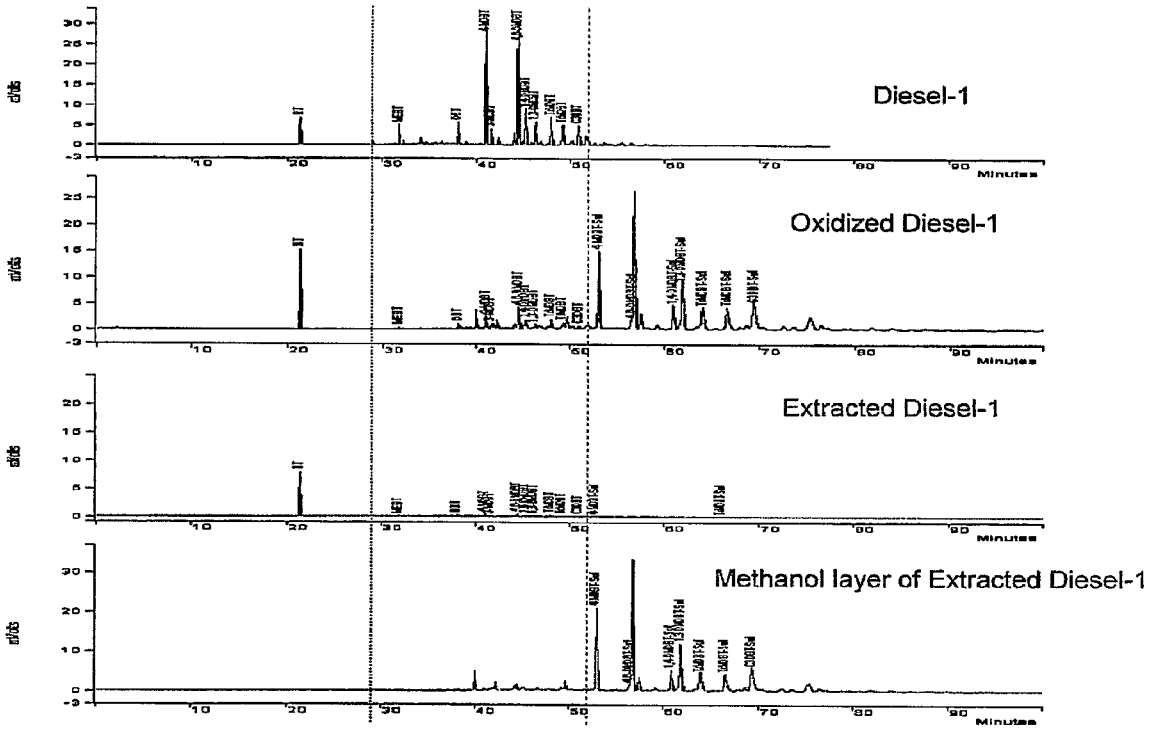
FIG. 4 is a series of gas chromatograms prepared for four different samples during the treatment of a commercial diesel product using the process of the invention.

Referring to FIG. 4, four (4) chromatograms depict the following: (a) the original diesel sample; (b) after the catalytic processing in accordance with Example 2; (c) after extraction by methanol as described in this example; and (d) the analysis of the methanol layer containing the extracted sulfones and sulfoxides.

The following Tables IV and V show that total sulfur content in the original sample of Diesel-1 was 405 ppmw and was reduced to less than 40 ppmw after the methanol extraction step.

TABLE IV

| Compound | Area Original Diesel-1 | Area After Treatment |
|---|---|---|
| BT* | 158 | 173 |
| MEBT | 153 | 26 |
| DBT | 215 | 48 |
| 4MDBT | 416 | 62 |
| 4,6-DMDBT | 338 | 67 |
| 1,4-DMDBT | 221 | 54 |
| 1,3-DMDBT | 244 | 45 |
| Tri-MDBT | 259 | 56 |
| Tri-MDBT | 199 | 29 |
| $C_3$DBT | 234 | 35 |
| Total Sulfur | 17058 | 1693 |

TABLE V

| Compound | ppmw | ppmw |
|---|---|---|
| MEBT | 4 | 1 |
| DBT | 5 | 1 |
| 4MDBT | 0 | 1 |
| 4,6-DMDBT | 8 | 2 |
| 1,4-DMDBT | 5 | 1 |
| 1,3-DMDBT | 6 | 1 |
| Tri-MDBT | 6 | 1 |
| Tri-MDBT | 5 | 1 |
| $C_3$DBT | 6 | 1 |
| Total Sulfur | 405 | 39 |

As will be understood from the above description and illustrative laboratory examples of the practice of the invention, the catalyst compounds disclosed are highly stable, of relatively simple structure and therefore economical, and can be reused.

The process is neither homogeneous nor heterogeneous, but rather is a biphasic system in which the catalyst is suspended in the solvent phase. This permits the treated liquid fuel to be easily separated from the reacted sulfur compounds and the solid catalyst particles to be separated for reuse or disposal, as appropriate.

The process of the invention provides a means of producing liquid transportation fuels that meet the developing environmental standards for ultra low-sulfur fuels.

The process can be practiced in the ambient to moderate temperature range and at ambient to moderate pressure, thereby making it economical from the standpoint of capital equipment and operational expenses.

This invention will safeguard the hydrocarbon product's quality and ensure the production of hydrocarbons having a near-zero sulfur content for use as transportation fuels, petrochemical production feedstreams and other uses that will meet current and future environmental regulations and legislation. The process of the invention will also eliminate or alleviate the need for flaring and reinjection in the refining industry and the discount pricing of hydrocarbon sales due to off-spec products.

The availability of a very low or substantially sulfur-free diesel fuel is potentially of great importance to the practical application of fuel cell technology to automotive use. Fuel cells require virtually sulfur-free diesel to make syngas for solid oxide fuel cells. Currently, no method is available to completely and easily remove sulfur from diesel fuel. The catalysts and process of the present invention can be used to remove sulfur from diesel easily and economically, and can thereby advance automotive fuel cell applications.

The invention has been illustrated by representative examples and comparative tests; however, other adaptations and variations will likely be apparent to those of ordinary skill in the art from this disclosure and the scope of the invention is to be determined with reference to the claims that follow.

We claim:

1. A method for reducing the amount of sulfur-containing compounds in a liquid hydrocarbon feedstream having sulfur-containing compounds comprising:

a. mixing, for a time that is sufficient to oxidize the sulfur-containing compounds to form sulfoxides and sulfones, the liquid hydrocarbon feedstream with a catalytic reaction mixture that includes a peroxide composition that is soluble in water or in a polar organic acid, at least one carboxylic acid, and a transition metal oxo-salt selected from the group consisting of $(NH_4)_2WO_4$, $(NH_4)_6W_{12}O_{40}.H_2O$, $Na_2WO_4$, $Li_2WO_4$, $K_2WO_4$, $MgWO_4$, $(NH_4)_2MoO_4$, $(NH_4)_6Mo_7O_{24}.4H_2O$, MnO and $NaVO_3$, wherein said peroxide composition and said transition metal oxo-salt form a stable peroxide intermediate which oxidizes said sulfur-containing compounds to sulfoxides and sulfones;

b. discontinuing the mixing when the amount of sulfur-containing compounds in the mixture have been oxidized to a predetermined level;

c. allowing the mixture to separate into an upper hydrocarbon layer and a lower aqueous layer containing a major portion of the catalytic reaction mixture and oxidized sulfur-containing compounds;

d. recovering the hydrocarbon layer; and e. treating the hydrocarbon layer to remove any oxidized sulfur-containing compounds carried over from the separation of step (c).

2. The method of claim 1 in which the transition metal oxo-salt is in the form of a finely-dispersed slurry.

3. The method of claim 1 in which the mixing in step (a) includes forming an homogenized composition.

4. The method of claim 1 in which the oxidation reaction is continued until the final amount of non-oxidized sulfur-containing compounds in the treated feedstream is reduced to 10 ppm, or less.

5. The method of claim 1, wherein the reaction is carried out at a temperature in the range of from 10° C. to 200° C.

6. The method of claim 5, wherein the temperature is in the range of from 50° C. to 90° C.

7. The method of claim 6, wherein the reaction is conducted at atmospheric pressure with mixing for approximately 30 minutes.

8. The method of claim 1, wherein the peroxide composition is selected from the group consisting of $H_2O_2$ and an organic peroxide selected from the group consisting of an alkyl peroxide, an aryl peroxide, a dialkyl peroxide, and a diaryl peroxide, wherein the alkyl and aryl groups of the respective dialkyl peroxideand diaryl peroxide are the same or different.

9. The method of claim 8, wherein the peroxide is 30% aqueous hydroperoxide.

10. The method of claim 1, wherein the carboxylic acid has from 1 to 20 carbon atoms.

11. The method of claim 10, wherein the carboxylic acid is selected from the group consisting of formic acid, acetic acid and propionic acid.

12. The method of claim 10, wherein the carboxylic acid is selected from the group consisting of acetic acid and propionic acid.

13. The method of claim 1 in which an organic polar solvent selected form the group consisting of methanol, ethanol, acetonitile, dioxin, methyl t-butyl ether, and mixtures thereof is added to the reaction mixture in step (a).

14. The method of claim 1 in which the sulfur-containing compounds in the feedstream are thiophenic compounds and the oxidized thiophenic compounds are extracted from the reaction mixture using a polar organic solvent selected from the group consisting of methanol, ethanol, acetonitrile, dioxin, methyl t-butyl ether, and mixtures thereof.

15. The method of claim 1 in which the oxidized sulfur-containing compounds are removed from the treated hydrocarbon stream by distillation, solvent extraction or selective adsorption.

16. The method of claim 1 which further includes:

g. recovering transition metal salt from the lower aqueous layer; and h. reusing the recovered transition metal salt in preparing the mixture of step (a).

17. The method of claim 16 which further includes washing the recovered transition metal salt prior to its reuse.

18. The method of claim 1 in which the feedstream is first treated by a hydrodesulfization process.

19. A catalyst mixture for use in the oxidative desulfurization of a hydrocarbon feedstream containing thiophenic compounds comprising:

(a) a peroxide composition as an oxidizing agent;

(b) a carboxylic acid in an aqueous medium, and (c) a transition metal salt selected from the group consisting of $(NH_4)_2WO_4$, $Na_2WO_4$, $Li_2WO_4$, $K_2WO_4$, $MgWO_4$, $(NH_4)_2MoO_4$ and $NaVO_3$.

20. The catalyst mixture of claim 19, wherein the carboxylic acid is selected from the group consisting of acetic acid and propionic acid.

* * * * *